United States Patent [19]

Thomas

[11] Patent Number: 4,922,564

[45] Date of Patent: May 8, 1990

[54] THERAPEUTIC MATTRESS AND METHOD OF MAKING

[76] Inventor: Charles R. Thomas, 120 E. Golden Gate, Detroit, Mich. 48203

[21] Appl. No.: 242,525

[22] Filed: Sep. 12, 1988

[51] Int. Cl.[5] ..... A47C 27/00

[52] U.S. Cl. ..... 5/464; 5/448; 5/474

[58] Field of Search ..... 5/474, 442, 448, 464, 5/449, 471, 480, 450

[56] References Cited

U.S. PATENT DOCUMENTS

| | | | |
|---|---|---|---|
| 1,900,801 | 3/1933 | Cobb | 5/448 |
| 1,941,785 | 1/1934 | Brown | 5/474 |
| 3,443,267 | 5/1969 | Schuckman | 5/442 |
| 3,737,929 | 6/1973 | Golembeck | 5/471 |
| 4,513,462 | 4/1985 | Thomas | 5/442 |
| 4,528,704 | 7/1985 | Wegener et al. | 5/453 X |
| 4,660,239 | 4/1987 | Thomas | 5/442 X |
| 4,688,283 | 8/1987 | Jacobson et al. | 5/449 |
| 4,766,627 | 8/1988 | Landry | 5/448 X |

FOREIGN PATENT DOCUMENTS

| | | | |
|---|---|---|---|
| 23075 | 7/1936 | Australia | 5/442 |
| 488276 | 9/1918 | France | 5/448 |

*Primary Examiner*—Alexander Grosz
*Assistant Examiner*—Michael J. Milano
*Attorney, Agent, or Firm*—Dykema Gossett

[57] ABSTRACT

A therapeutic mattress comprises a soft, resilient bottom mattress section and a plurality of interconnected top mattress sections and peripherally interconnected. The top section includes top and bottom fabric covers peripherally interconnected. A plurality of parallel rows of stitching interconnect the top and bottom covers and with the peripherally stitching define a plurality of transverse rectangular tubes filled with a compacted resilient fibrous material. The bottom mattress section includes a bottom fabric cover spaced from the top section bottom cover and peripherally interconnected defining an elongated rectangular chamber underlying the top mattress sections. A loosely confined resilient fibrous material is enclosed and retained within the chamber yieldably underlying the top mattress sections.

3 Claims, 2 Drawing Sheets

Fig-1
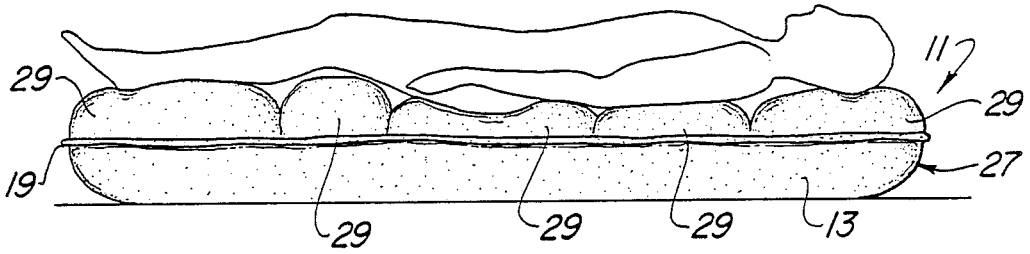
Fig-2
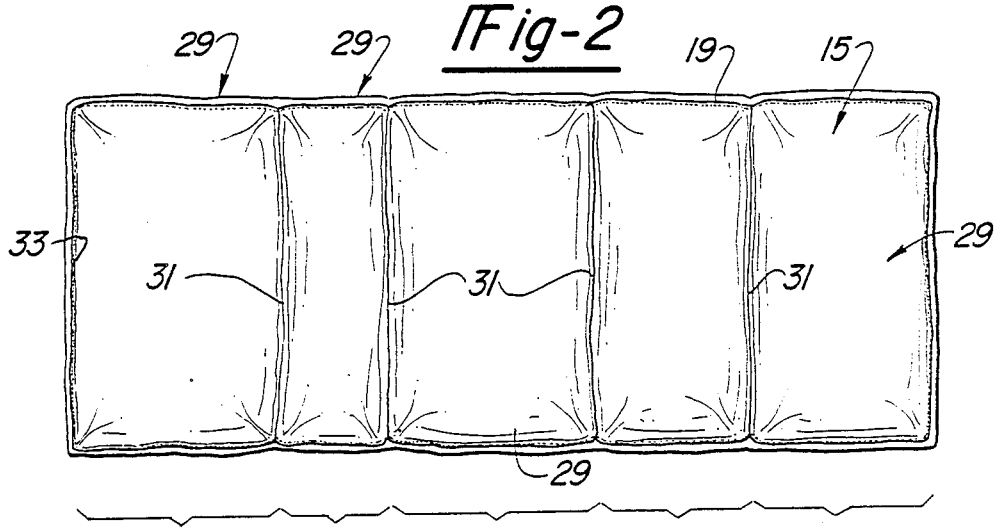
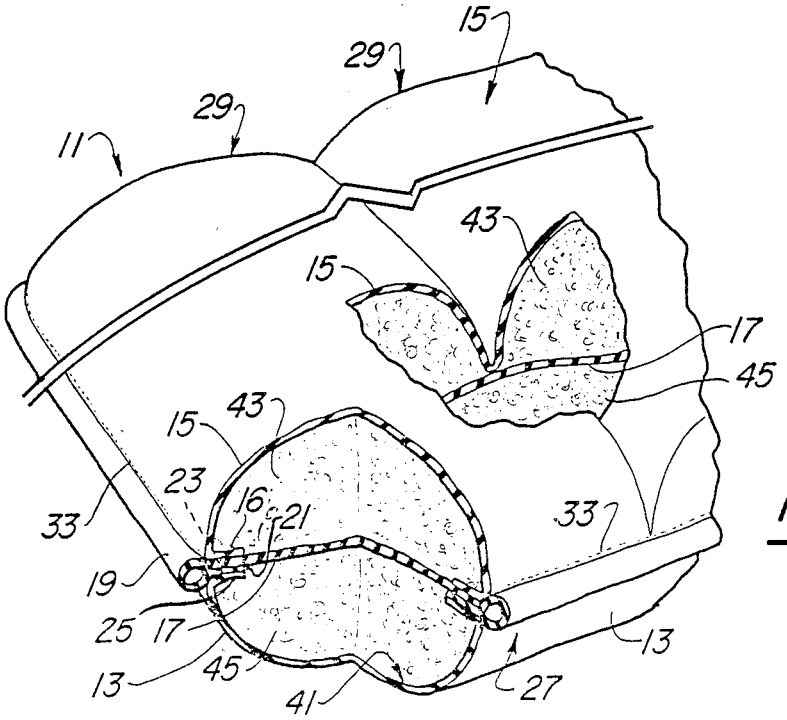
Fig-3

THERAPEUTIC MATTRESS AND METHOD OF MAKING

FIELD OF INVENTION

The present invention relates to mattresses and more particularly to a therapeutic mattress which has a soft and resilient bottom mattress section and thereover a plurality of interconnected top mattress sections secured thereto.

BACKGROUND OF THE INVENTION

To the extent known, mattresses heretofore have been constructed of top and bottom covers of a fabric material and interposed between cotton or other resilient batting or other resilient material with portions of the top and bottom covers of the mattress quilted or interconnected to define a matress of substantially uniform resilience throughout its length and width. One of the disadvantages of conventional mattresses is that it is of substantial and uniform resiliency throughout its length and width such that the user receives a uniform support for his entire body which under some situations has resulted in serious backache or other discomforts after a number of hours of use. Previously known mattresses do not give attention to or provide individual and more firm support for certain specific areas of the user's body, as for example the head, back, torso, knees and feet, but on the other hand appear to provide a substantially resilient support for the body, regardless of the position of the user with the various above-identified elements of the body making yieldable indentations into the mattress depending upon its degree of firmness.

THE PRIOR ART

The present mattress construction represents a modification of the teaching of the Applicant's prior United States patents relating to therapeutic pillows, namely U.S. Pat. No. 4,513,462 of Apr. 30, 1985 and U.S. Pat. No. 4,660,239 of Apr. 28, 1987.

The foregoing patents disclose the concept of making a two-piece pillow wherein the pillow consists of a pair of sections with an upper section having certain stiffened portions and with a bottom section being less stiff and of uniform resiliency underlying the stiffened portions in order to provide for improved head and neck support in the use of pillows.

SUMMARY OF THE INVENTION

An important feature of the present invention is to provide an improved therapeutic mattress which includes a soft, resilient bottom mattress section and a plurality of interconnected top mattress sections thereover and peripherally connected thereto.

As another feature, the top mattress sections include top and bottom fabric covers peripherally interconnected together with a plurality of parallel rows of stitching interconnecting the top and bottom covers of the top mattress sections and with the peripheral stitching between the top and bottom mattress sections defining a plurality of transverse rectangular tubes in the top mattress sections which are filled with a compacted resilient fibrous material. The bottom mattress section includes a bottom fabric cover spaced from the bottom cover of the top mattress sections and peripherally connected thereto to define an elongated rectangular chamber which underlies the top mattress sections. A loosely confined resilient fibrous material is enclosed and retained within the chamber to yieldably underlie the top mattress sections.

As another feature, the present therapeutic mattress includes a plurality of top mattress sections having a top fabric cover and spaced therefrom an underlying intermediate bottom fabric cover with the covers peripherally interconnected together with a plurality of laterally spaced rows of continuous stitching interconnecting the top and intermediate covers throughout their width, with the rows of stitching and the peripheral stitching defining a plurality of rectangular tubes which are filled with a compacted stuffing of a resilient fibrous material to define the top mattress sections, and wherein the bottom mattress section includes a second bottom fabric over spaced from the intermediate bottom fabric cover and peripherally connected thereto, defining an elongated rectangular chamber which underlies the top mattress sections together with a loosely confined stuffing of a resilient fabric fibrous material enclosed and retained within the chamber and yieldably underlying the top mattress sections.

These and other features and objects will be seen from the following specification and claims in conjunction with the appended drawings.

THE DRAWINGS

FIG. 1 is a side elevational view of the therapeutic mattress with a user supported by a plurality of top mattress sections.

FIG. 2 is a top plan view of the therapeutic mattress shown in FIG. 1.

FIG. 3 is a fragmentary perspective view of the therapeutic mattress with portions broken away and sectioned to illustrate the construction of the top and bottom mattress sections of the therapeutic mattress.

Figure 4:
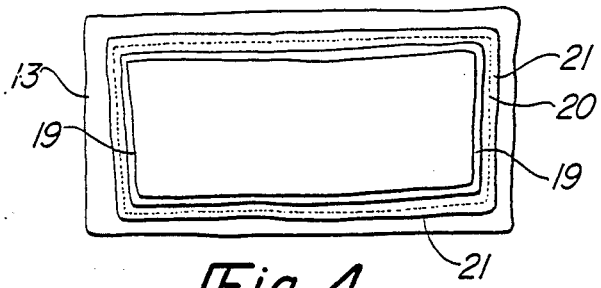
FIG. 4 is a schematic plan view of the bottom cover of the bottom mattress section showing the initially step of applying a peripheral beading thereto.

It is to be understood that the above drawings, including the schematic views, FIGS. 4–10, are illustrative of one embodiment of the invention and the method steps involved in constructing the mattress and that other embodiments or variations in the method steps are contemplated within the scope of the claims hereafter set forth.

DETAILED DESCRIPTION OF AN EMBODIMENT OF THE INVENTION

The present therapeutic mattress 11 includes a bottom cover 13 of a suitable fabric material such as sanforized cotton or the like, a top fabric cover 15, FIG. 2, having an inturned internal assembly flange 16, FIG. 3.

The present thereapeutic mattress 11 is generally rectangular in shape having spaced ends and sides and includes soft resilient bottom mattress section and a plurality of transverse interconnected top mattress sections 29 which are arranged side by side and superimposed over and along the length of the mattress bottom section 27. The top mattress sections include top fabric cover 15 and spaced therefrom the underlying intermediate bottom fabric cover 17, fragmentarily shown in FIG. 3, and wherein the bottom mattress section 27 and the corresponding plurality of top mattress sections 29 are peripherally interconnected as by the stitching 33 shown in FIG. 3.

The top sections 29 define tubes generally half oval-shaped in cross-section.

The tubular binding 19, sometimes referred as beading, extends around the therapeutic mattress intermediate its height and is peripherally connected to adjacent portions of the corresponding covers of the top and bottom mattress sections.

The binding or beading 19 includes a binding flange 21 which overlies the inturned peripheral flange 25 of the bottom cover 13 and is secured thereto by the preliminary internal stitching 20 and 23, FIGS. 3, 4, 8 and 9.

The present plurality of laterally interconnected top mattress sections 29 overlie the soft resilient bottom mattress section 27 and are peripherally connected thereto as at 33, FIGS. 2 and 3.

Figure 6:
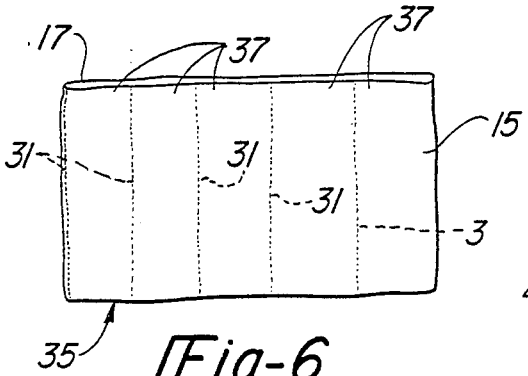
FIG. 6 is a plan view of the folded over top and intermediate bottom fabric covers shown in FIG. 5 with a series of rows of stitching applied thereto.
Figure 7:
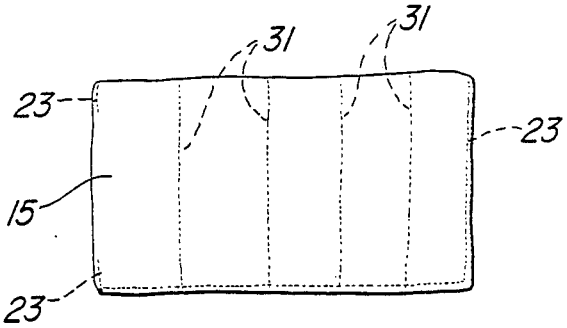
FIG. 7 is a plan view of the top and intermediate bottom covers of FIG. 6 positioned over the bottom cover of the bottom mattress section of FIG. 4.
Figure 10:
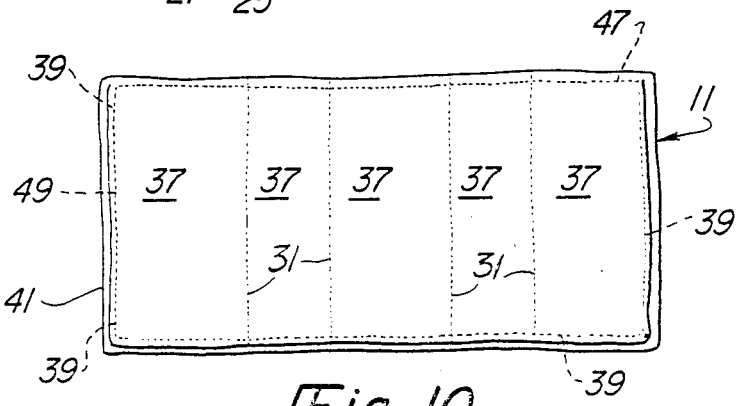
FIG. 10 is a plan view illustrating the final assembly and securing of the top mattress section over the bottom mattress section and wherein there are defined a plurality of tubes in the top section and a unit chamber formed within the bottom mattress section and underlying said tubes.

Respective top mattress sections 29 are arranged side by side and laterally interconnected by the transverse stitching 31 which extends between the sides of the top mattress sections, as further shown in FIGS. 6, 7 and 10.

METHOD OF ASSEMBLY

Figure 5:
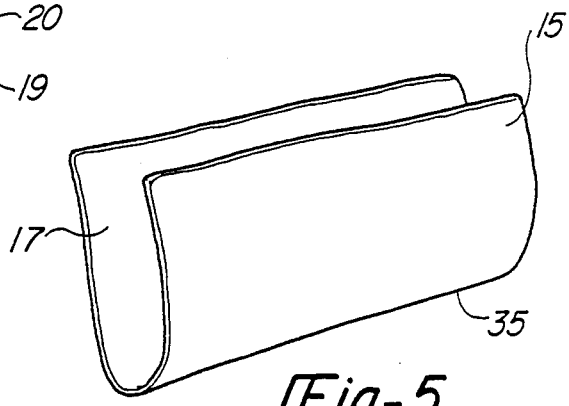
FIG. 5 is a perspective view of a strip of fabric material folded over to define for the top mattress sections a top fabric cover and an underlying intermediate bottom fabric cover.
Figure 8:
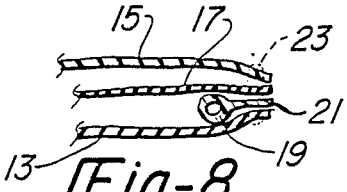
FIG. 8 is a fragmentary cross-sectional view illustrating the stitching and assembly of the top fabric cover, the bottom intermediate cover and the bottom cover of the bottom section of the mattress with the beading stitched thereon.
Figure 9:
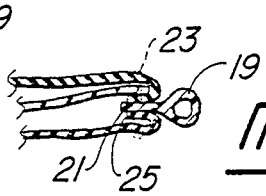
FIG. 9 is a similar view of the assembly shown in FIGS. 7 and 8 turned inside-out so that the beading mount strip and the stitching therefor are upon the interior of the mattress assembly.

The present method of making the therapeutic mattress 11 of FIGS. 1 and 2 includes the steps of:

(1) taking a first sheet 13 of a fabric material of rectangular shape and stitching thereto the peripheral beading or binding 19 with the beading having a flange 21 anchored to the first sheet or bottom cover sheet as by the preliminary stitches 20 shown in FIG. 4;

(2) taking a second sheet of fabric material, FIG. 5, folding it over to provide top cover 15 and an intermediate bottom cover 17 of the same dimensions as the first sheet 13;

(3) applying a plurality of parallel rows of stitching across the width of the top cover 15 and underlying intermediate bottom cover 17 defining a plurality of tubes 37 open at one end;

(4) superimposing the folded-over second sheet 15–17 with stitches 31 thereon over the first sheet 13, FIG. 7, and applying the stitching 23, FIG. 7, to one end to close off the side of the end tube 37 shown in FIG. 6 and extending along the bottom of the assembly shown in FIG. 7 with a short amount of end stitching about 2½ to 3½ inches to the one ends of the assembly shown in FIG. 7 and designated at 23;

(5) FIG. 8 is illustrative of the arrangement of the binding 19–21 upon the interior of the assembly of the covers. Thereafter, the assembly shown in FIG. 8 is turned inside-out so that the binding or beading 19 is upon the exterior of the respective top and intermediate covers and the bottom cover, as in FIG. 9.

In the final step, FIG. 10, with the cover sheets 15 and 17 superimposed over the bottom sheet 13 there is provided the final stitching 39 across one end and along the bottom of the assembly. This defines between the top mattress sections and the bottom mattress section a rectangular chamber or bottom tube 41 which underlies the top mattress sections 29;

(6) a further step includes stuffing, filling, compacting and retaining a fibrous material 43 within the plurality of transverse tubes 37 to define the plurality of firm resilient top mattrêss sections 29; and (7) further stuffing, filling and retaining a resilient fabric material 45 within the bottom chamber 41 defining the bottom mattress section 27 which underlies the plurality of top mattress sections 29.

As an intermediate step, after the stuffing of the tubes 37, shown in FIGS. 6 and 10, there is the step of stitching as at 47 across the tops of the respective tubes so as to confine the stuffed resilient material 43 therein.

As a final step, after the stuffing of the resilient fibrous material within the bottom chamber 41, there is a final transverse stitching at 49, FIG. 10, to close off the bottom chamber and for retaining the resilient stuffing material 45 therein.

In the illustrative embodiment, the material employed are preferably polyester fibers. It is regarded as equivalent that stuffing could be of down, feathers and cotton.

As shown in FIGS. 1 and 3, the sides and ends of the bottom mattress section are curved upwardly along a line around the mattress intermediate its height. The sides and ends of the top mattress section are curved downwardly to a line around the mattress intermediate its height and to the stitching 31. The peripheral stitching 33 around the mattress is generally arranged its height at the junction of the top and bottom sections as shown in FIGS. 1 and 3.

In the illustrative embodiment, the present mattress has a width of approximately 42 inches, the respective top mattress sections have widths as follows approximately:

head-18 inches
back-15 inches
torso-20 inches
knees-10½ inches
feet-20 inches

In the illustrative embodiment, the respective top mattress sections 29 are of substantially uniform density with the fibrous material 43 reasonably confined and packed within the respective top mattress sections. It is contemplated, however, that the fibrous material compacted within the foot section may be of less density for increased comfort of the user.

Having described my invention reference should now be had to the following claims.

I claim:

1. A therapeutic mattress of rectangular shape having spaced ends and sides comprising:

a resilient bottom mattress section;

a plurality of transverse interconnected top mattress sections arranged side by side superimposed over and along the length of the mattress bottom section;

peripheral stitching interconnecting the top and bottom mattress sections;

the top mattress sections including a top fabric cover and spaced therefrom an underlying intermediate bottom fabric cover with said covers peripherally interconnected;

a plurality of laterally spaced rows of continuous stitching interconnecting the top and intermediate covers throughout their width;

said rows of stitching defining with said peripheral stitching a plurality of transverse rectangular tubes of generally rectangular cross-section which extend uninterrupted substantially across the entire width of the mattress;

compacted stuffing of resilient fibrous material confined and retained within said transverse tubes defining said top mattress sections;

said bottom mattress section including a second bottom fabric cover spaced from and generally parallel to said intermediate bottom fabric cover and peripherally connected thereto defining an elongated rectangular chamber underlying said top mattress sections: and a loosely confined stuffing of a resilient fibrous material enclosed and retained within said chamber and yieldably underlying said top mattress sections.

2. In the therapeutic mattress of claim 1, further comprising:

the sides and ends of said bottom mattress section being curved upwardly to a line around the mattress intermediate its height:

the sides and ends of said top mattress sections being curved downwardly to a line around the mattress intermediate its height and to said rows of stitching;

with said peripheral stitching extending around the mattress intermediate its height at the junction of said top and bottom mattress sections.

3. In the therapeutic mattress of claim 1, further comprising said intermediate cover being generally planar and said tubes being generally half-oval shaped in cross-section.

* * * * *